United States Patent [19]

Woodbine

[11] 4,253,014

[45] Feb. 24, 1981

[54] RESETTABLE COUNTER FOR POSTAGE METER

[75] Inventor: Wilfred J. Woodbine, Harlow, England

[73] Assignee: Pitney Bowes Inc., Stamford, Conn.

[21] Appl. No.: 14,513

[22] Filed: Feb. 23, 1979

[30] Foreign Application Priority Data

Feb. 24, 1978 [GB] United Kingdom ..... 7560/78

[51] Int. Cl.[3] ..... G06M 1/274

[52] U.S. Cl. ..... 235/92 AC; 235/92 EA; 235/92 ST

[58] Field of Search ..... 235/92 EA, 92 AC, 92 ST, 235/92 PE, 101

[56] References Cited

U.S. PATENT DOCUMENTS

| | | | |
|---|---|---|---|
| 3,624,362 | 11/1971 | Kelch | 235/92 EA |
| 3,896,298 | 7/1975 | Haydon | 235/92 EA |
| 3,914,583 | 10/1975 | Einem et al. | 235/92 EA |
| 4,090,063 | 5/1978 | Martin | 235/92 ST |

*Primary Examiner*—Joseph M. Thesz

*Attorney, Agent, or Firm*—Robert E. Meyer; William D. Soltow, Jr.; Albert W. Scribner

[57] ABSTRACT

In a postage meter which can be set to imprint a selected value of postage on individual mail pieces, two counters are typically provided for accounting purposes. One counter is an accumulating counter into which the postage value imprinted during each operation is added. The second counter is settable by the Postal Service to the amount of postage purchased by the meter user. As postage is imprinted by the meter, the value of the postage is subtracted from the second counter. Thus, this counter continuously indicates the amount of postage that remains available for imprinting. The meter of the present invention additionally provides an operator resettable counter to indicate the total value of postage imprinted on any group of consecutive mail pieces. The function and operation of the original counters are completely separate and unaffected by the present invention.

4 Claims, 6 Drawing Figures

RESETTABLE COUNTER FOR POSTAGE METER

BACKGROUND OF THE INVENTION

This invention relates to counter mechanisms and in particular to counter mechanisms for use with postage meters.

A type of postage meter in common use has means to imprint varying postal amounts on individual mail pieces, a selecting mechanism for setting the amount of postage to be imprinted onto a particular item of mail, and counters which perform accounting functions for the value of postage that has been imprinted by the postage meter. The actual postage imprinting is done by a printing die mounted on a rotating shaft. This main shaft rotates once for each imprinting operation and the postage amount that the user has selected by the selector mechanism is imprinted onto the mail piece and the value of this postage is transferred into the counters. Typically, there are two types of counters on the postage meter. One is simply an accumulating counter which shows the total amount of postage that has been imprinted by the postage meter. The second counter is known as a descending counter in that as postage is imprinted by the meter, the value of this postage is subtracted from this second counter. The second counter may be set by the Postal Service for an amount of postage that is purchased by the user. In operation, each of the imprinted postage values are added to the first counter and subtracted from the second counter. The meter will lock itself from further operation when the amount remaining in the descending counter approaches a preset amount. The meter must then be taken to the Postal Service and the second counter reset to indicate the amount of additional postage that has been purchased. With the exception of access by the Postal Service to the descending counter, these counters are completely sealed within the meter to prevent tampering. A postage meter of the abovementioned type is the Model 5300 series manufactured by Pitney-Bowes, Inc. of Stamford, Conn.

A single postage meter is often used by a number of different individuals or by different departments of an organization and it is desirable to keep track of the amount of postage that is used by each of these different users. Because each mail piece may need a different amount of postage imprinted thereon, one cannot simply multiply the number of mail pieces by a single postage amount to determine how much postage has been imprinted. The method commonly used is to manually record the reading of one of the counters before operating the meter and then recording the reading of the same counter after all of the mail pieces have been imprinted. Then it is necessary to subtract one of the readings from the other to determine the amount of postage that was used during the operation of the meter. While this procedure is not a difficult one, it is subject to mistakes in arithmetic and users may forget that they must record the reading of the register before they initiate the operation of the meter. They often remember this procedure only after having imprinted a few mail pieces thus forcing them to add in the amount of the individual pieces already run and further complicating the procedure.

Accordingly, the present invention seeks to overcome these drawbacks by providing an additional counter which is reset by the operator prior to each use of the meter and provides a count of the value of postage that was imprinted during the meter's operation.

SUMMARY OF THE INVENTION

The invention provides a postage meter for imprinting a postage value onto a mail piece and having at least one counter for postal accounting purposes. The meter includes a selector mechanism for selecting the amount of postage to be imprinted onto a particular item of mail, and a main shaft which rotates once to complete a postage imprinting operation whereupon the value of the amount imprinted is transferred into the counter. The meter further includes a resettable counter means for providing a resettable total count of postage values imprinted. This resettable counter means includes a plurality of switches settable by the selector mechanism to correspond to the amount set into this mechanism for imprinting postage. The resettable counter means further includes an electronic accumulating register, means to sample the plurality of switches as a postal imprinting operation takes place and to thereby enter into said register the amount set upon the selector mechanism. A readout of the display for the register and reset means for resetting the register to zero are also provided.

With the invention above defined, the total of postage used on any batch of consecutive items of mail is automatically totaled and can be read out, and the register reset for the next batch. There is no need to take readings from the present counters and make a subtraction. The counters already in the meter and their attendant security systems are unaffected.

The switches can be wafer switches driven by indicator wheels forming part of the selector mechanism. The sampling means can be reed switches actuated momentarily in the required order by a magnet rotating with a shaft which turns one revolution for each imprinting operation. The register can be a semiconductor chip such as now made in great numbers for pocket calculators. The read-out display can be of the liquid crystal type, actuated on a press-to-read basis. Power for the device is preferably supplied by a battery permanently connected to the register.

The invention will be further described with reference to the accompanying drawings, which illustrate one form of postage meter incorporating the invention, and various modifications of this meter.

IN THE DRAWINGS

FIG. 1 is a perspective view of a postage meter, with a corner of the casing shown cut away to reveal interior parts;

FIG. 1*a* is a circuit diagram of a means to provide a resettable total count, forming part of the FIG. 1 postage meter:

FIGS. 2, 3, 4, and 5 are further perspective views of postage meters each being a modified form of that shown in FIG. 1.

DETAILED DESCRIPTION

Figure 1:
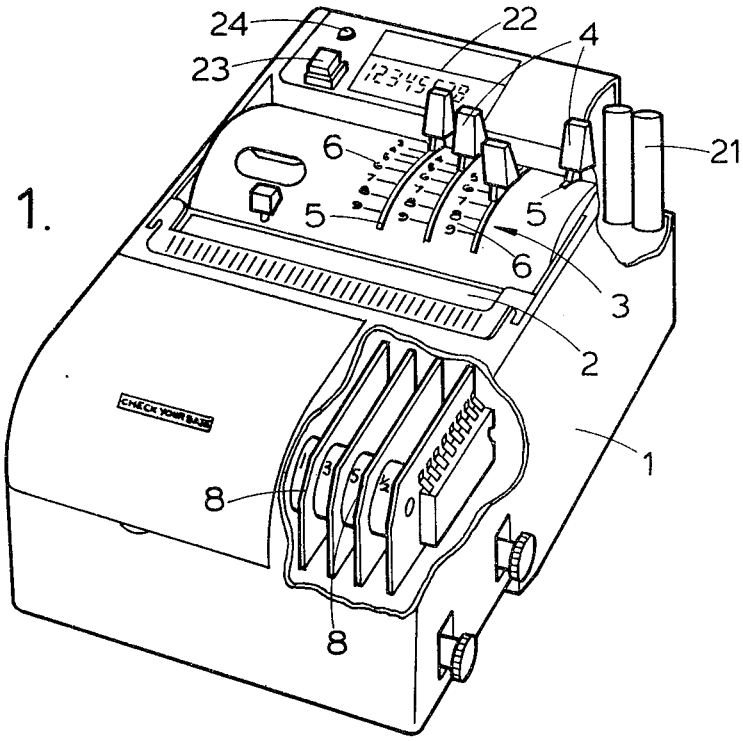

Referring to FIG. 1, the postage meter there shown is a modified version of the aforementioned model 5300 Pitney Bowes meter and comprises a casing 1 within which is a counter (not shown) to be set to the amount of postage purchased and acting as a current account meter. A first window 2 displays the accumulated total of postage used. A second window is commonly provided at the rear of the casing to display the value of postage remaining (i.e. a "credit" display), but is not present in the machine shown. (A rear window "credit" display is shown in the meter in FIG. 5). The counter is reset only when additional postage is purchased and the counts in the second window (if provided) are only reset at this time.

The amount to be imprinted onto a particular item of mail is set on a selector mechanism designated generally 3 comprising a bank of levers 4, in this case four in number, which can be moved in slots 5 to positions indicated by the numbers 6 shown on the casing. A selector mechanism of this type is more fully described in U.S. Pat. No. 2,657,593. The selector mechanism 3 includes indicator wheels 8 located in the front portion of the meter. The setting of a lever 4 to a particular number 6 causes the corresponding indicator wheel 8 to show that number. The indicator wheels 8 are connected to the levers 4 by any suitable mechanism (not shown) such as an arm which is attached to the lever 4 at one end and which has rack teeth at the other end which engage a gear attached to each indicator wheel. With the setting shown in FIG. 1, the postage imprinted will be $1.35½.

The postage meter illustrated is designed for use with a base which contains a motor and drive mechanism for the meter. The meter is set to the desired postage value by positioning the individual levers 4 and this amount of postage is shown on the indicator wheels 8. Then, in an imprinting operation, an item of mail is moved over the base past the meter and is printed by it. In the imprinting operation a main shaft (not shown) is rotated one revolution and in the course of this rotation a printing die carried by the main shaft prints the postage on the mail piece and the amount of this printed postage, as shown on the indicator wheels 8, is added to the accumulated total shown in the window 2 and subtracted from the value of postage remaining appearing in the rear window (not shown). A main shaft and printing die for a postage meter is more fully shown in U.S. Pat. No. 2,829,591.

Figure 1A:
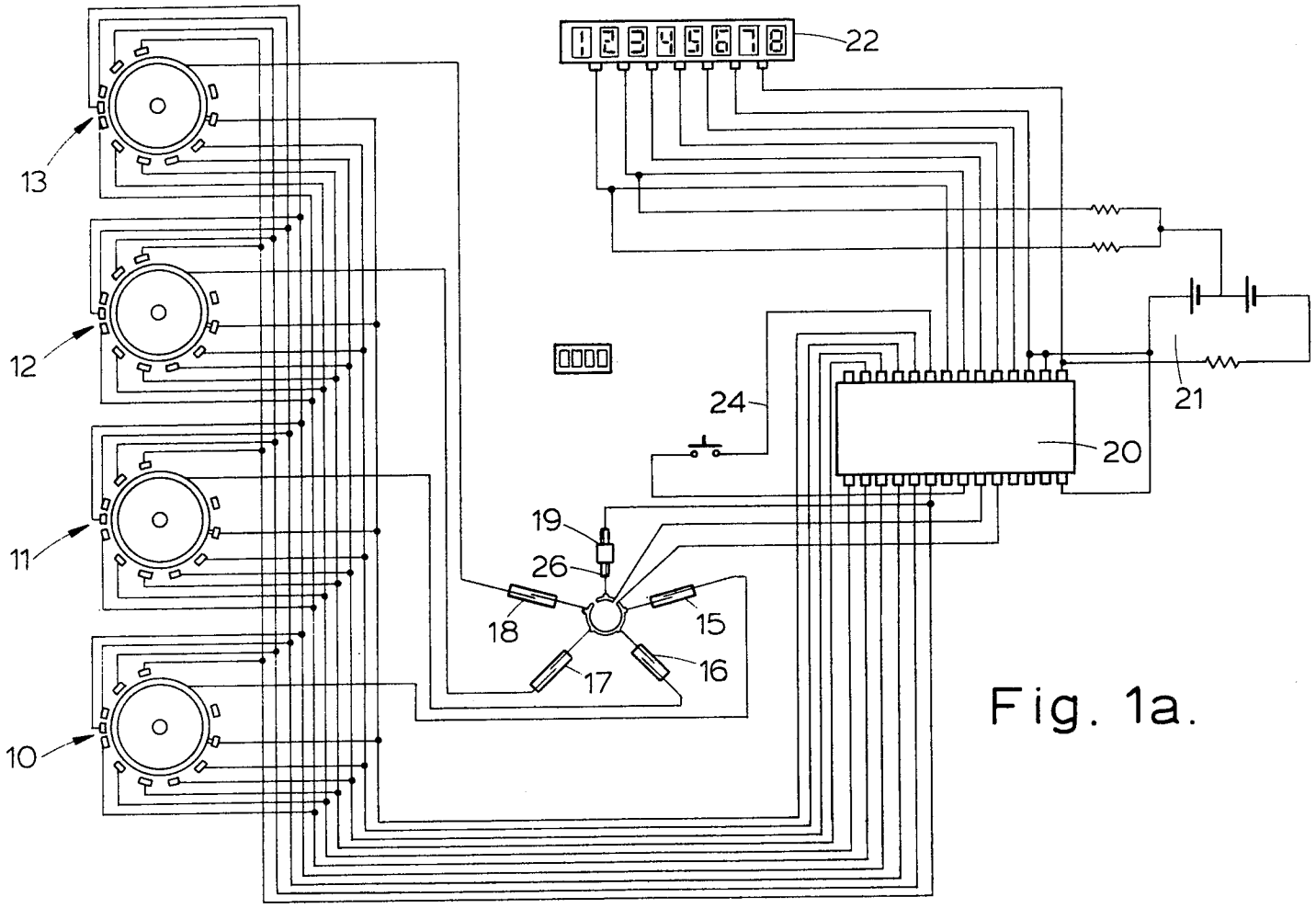

Each of the indicator wheels 8 has a printed circuit wafer inserted alongside it with a printed switch pattern. These patterns are shown at 10, 11, 12, 13 in the circuit diagram of FIG. 1*a*. Contacts (not shown) are attached to the individual indicator wheels 8. The printed circuit wafer has a contact for each of the numbers shown on the indicator wheel.

Reed switches 15, 16, 17 and 18 are located around the main shaft, (FIG. 1*a*) one corresponding to each switch pattern 10 to 13. A magnet is mounted on the shaft to cause the reed switches momentarily to make contact one after the other.

An accumulating register provided by an electronic integrated circuit chip 20 such as used in pocket calculators is energized by a permanently connected battery 21. The register output is connected to a liquid crystal display or read-out 22 also actuated by the battery, through a press-to-read switch not shown in the circuit diagram but illustrated at 23 in FIG. 1. The register has a reset button 24.

It will be seen that the switch contact positions on all the wafer switch patterns, 10, 11, 12, 13 are connected together: that is, all positions 0 are connected together, all positions 1 connected together, all positions 2 connected together, and so on. All positions 0 are connected to the 0 input point of the calculator chip 20, positions 1 to input point 1, positions 2 to input point 2, and so on. The common of each switch wafer pattern 10 to 13 is connected to its corresponding reed switch 15 to 18. The other sides of the reed switch 15 to 18 are connected together and also to the common of all the number inputs on the calculator chip 20.

In FIG. 1 the indicator wheels are set to $1.35½. This provides contact as follows:

switch pattern 10—contact 1
switch pattern 11—contact 3
switch pattern 12—contact 5
switch pattern 13—contact 5

On rotations of the main shaft the reed switches 15 to 18 connect momentarily the switch patterns 10 to 13 in turn to the calculator chip to set the numbers 1–3–5—5 into the chip.

There is a fifth reed switch 26 connected between the common and the + junction on the chip 20. When the shaft reaches its home position the magnet 19 actuates the reed switch 26 to add the number set into the chip 20 to the previous total. The new total is available for the liquid crystal display 22. No numbers can be set into the chip by outside interference.

Since the battery is connected permanently to the calculator chip then the total of the chip will be held and the machine is not dependent for this on mains power. The calculator chip can be of the most simple type using C-MOS technology. This minimizes drain on the battery as does also the use of liquid crystal display, used on a press-to-read basis. Although other types of switches can be used instead of the reed switch as shown, the latter arrangement has the advantage that no battery power is consumed.

It is expected that small button batteries would give a life of three months continuous use, and larger batteries would enable this to be increased threefold.

The various components of the resettable counter of the present invention have to be accommodated with the conventional components of the postage meter. Various ways in which this can be done are illustrated in the drawing. The postage meter there shown is again the Pitney Bowes model 5300.

In FIG. 1, no rear display for postage remaining is provided. The space normally occupied by this can be used for the liquid crystal display 22, reset button 24 and press-to-display button 23.

The selector switch wafers 10–13 can be housed in between the indicator wheels 8 at the front of the machine. The calculator chip 20 and all associated circuitry can also be accommodated on the same printed circuit boards in the compartment provided behind the wheels. The batteries can be housed in the space where otherwise would be located the mechanism operating the postage remaining display.

For the reed switches 15 to 18 and magnet 19 a special unit would require to be designed and driven at one to one ratio by the main shaft. This unit would be approximately 1¼" diameter by 1¼" long. Space would be found for this over the main shaft.

Figure 2:
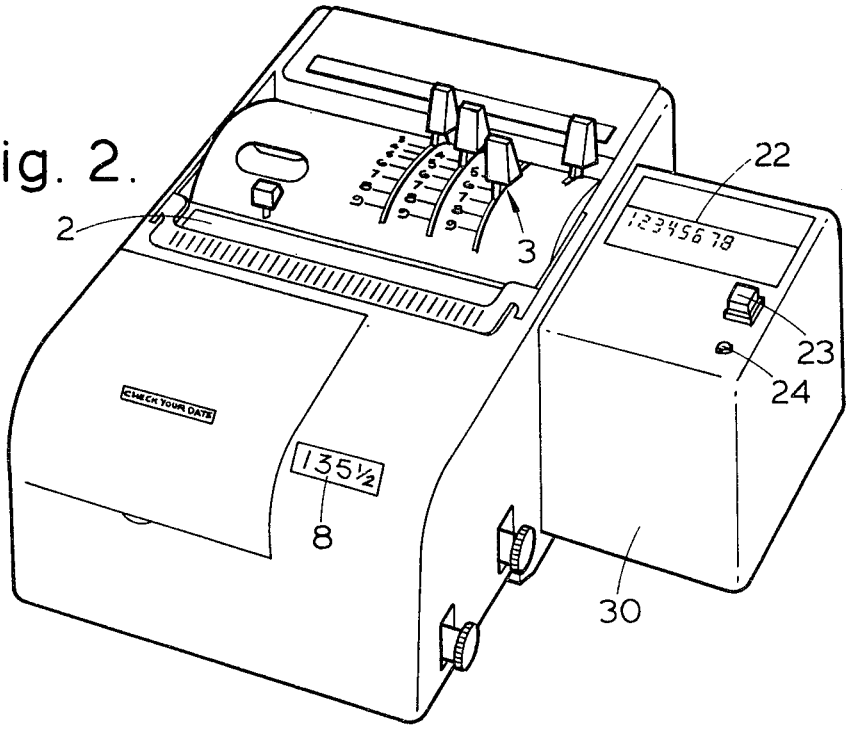

FIG. 2 shows a meter having displays for both postage used and postage remaining, having a projection 30 on the casing to locate components of the invention. In this configuration the width of the projection 30 is determined by the length of the liquid crystal display 22 and it has been positioned in this way so that the display is adjacent the other displays of the machine.

The batteries 21, drive mechanism for moving the magnet 19 and all the reeds 15 to 18 and 26 are housed inside the projection 30. The drive for the magnet 19 is obtained from a connection to the end of the actuator shaft which rotates once for each operation of the meter. The selector switch wafers and calculator chip would be housed as shown in FIG. 1.

Figure 3:
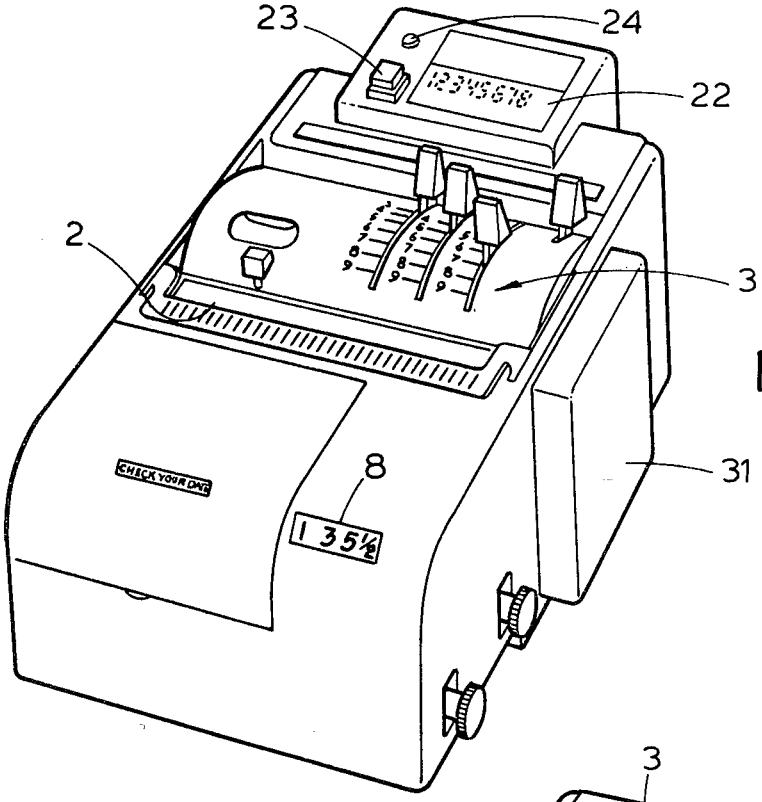

In the FIG. 3 configuration, the display 22 is housed on the top of the opening door behind the window where postage remaining is shown. The drive mechanism would be housed in a projection 31 on the casing as in the FIG. 2 construction but the width of the projection would be only slight. The selector switch wafers and calculator chip would be housed as shown in FIG. 1.

Figure 4:
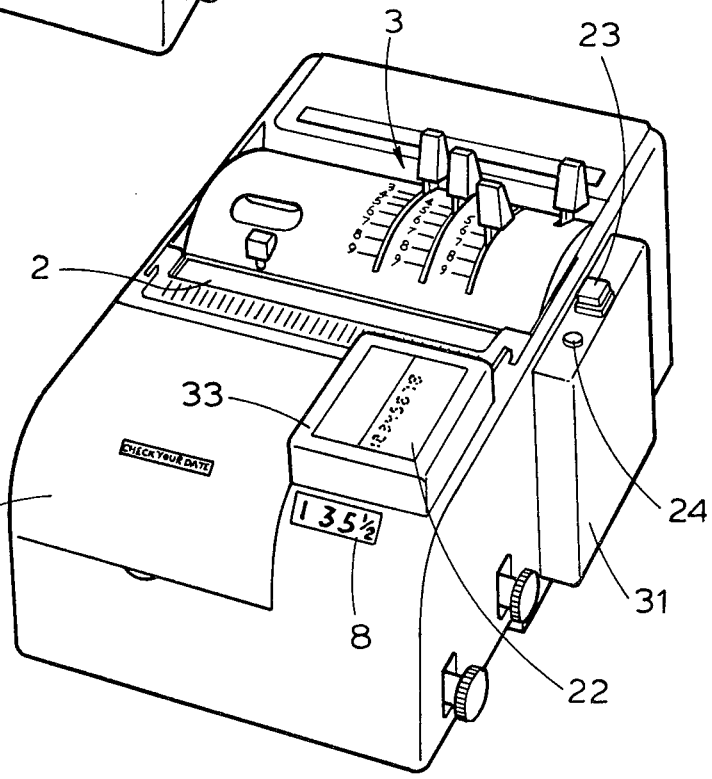

In the FIG. 4 configuration, the display 22 is housed in a projection 33 above the casing just behind the selector indicator wheels. In this location the display is at right angles to the other dials as it is too wide to be arranged the other way due to the door 34 which must not be obstructed. The drive mechanism is as in FIG. 3.

Figure 5:
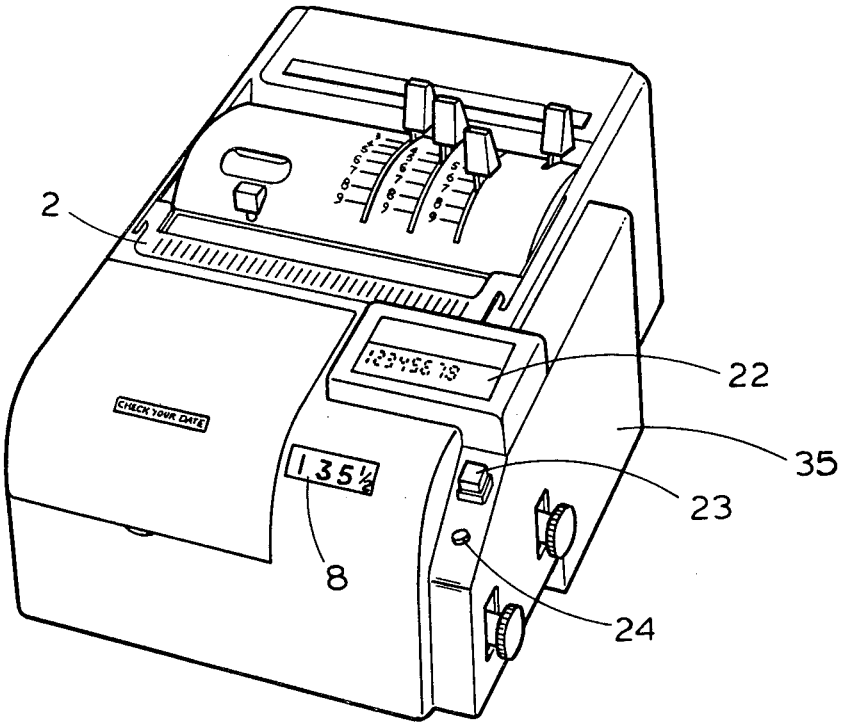

In FIG. 5, projection 35 for the battery and drive mechanism extends to the front of the machine. The liquid crystal display is here placed parallel to the other displays.

The invention can be adapted for mechanical counters other than for postage meters, where an auxiliary counter is needed that can be reset to zero at will.

What I claim is:

1. In a postage meter for imprinting a postage value onto a mail piece and having at least one counter for postal accounting purposes, a selector mechanism for selecting the amount of postage to be imprinted onto a particular item of mail comprising a plurality of selector elements each manually settable to positions defining a part of the postage amount to be imprinted, and a main shaft which rotates once to complete an imprinting operation whereupon the value of the amount imprinted is transferred into said counter; the improvement comprising a resettable counter means for providing a resettable total count of postage values imprinted; said resettable counter means comprising:

A. A plurality of switches settable by the selector mechanism to correspond to the amount set into said mechanism for imprinting postage, said switches comprise, for each said selector element, a switch assembly including a set of contacts and a cooperating member movable relatively thereto;

B. an electronic accumulating register, said contacts of said switch assembly being connected to inputs on said register corresponding to the positions to which said selector element can be set;

C. means to sample said plurality of switches as a postal imprinting operation takes place and thereby enter into said register the amount set upon the selector mechanism, said means to sample said switches includes means to energize each switch assembly in turn so as to enter into the register in turn the parts of the postal amount to be imprinted as defined by the settings of the selector elements;

D. a read-out display for said register; and

E. reset means for resetting said register to zero.

2. A postage meter as claimed in claim 1, wherein the means to energize each switch assembly in turn is a circular arrangement of reed switches and a magnet rotatable with the main shaft to close each reed switch in turn.

3. A postage meter as claimed in claim 2, including an additional reed switch at the home position of the magnet which is connected to the register whereby when the magnet reaches the home position the amount set into the register for the previous rotation is added to the amount already in the register.

4. A postage meter as claimed by claims 1, 2 or 3 wherein the selector mechanism includes indicator wheels which indicate the postage amount set by the selector mechanism and each said selector element is associated with an individual indicator wheel, and the associated switch assembly comprises a wafer switch driven by said indicator wheel.

* * * * *